US008366252B2

(12) United States Patent
Zaba et al.

(10) Patent No.: US 8,366,252 B2
(45) Date of Patent: Feb. 5, 2013

(54) INK JET PRINTING

(75) Inventors: Jerzy Zaba, Cambridge (GB); Ian Fost, Manea (GB)

(73) Assignee: Videojet Technologies Inc.

( * ) Notice: Subject to any disclaimer, the term of this patent is extended or adjusted under 35 U.S.C. 154(b) by 322 days.

(21) Appl. No.: 12/680,926

(22) PCT Filed: Oct. 9, 2008

(86) PCT No.: PCT/GB2008/003410

§ 371 (c)(1),
(2), (4) Date: Mar. 31, 2010

(87) PCT Pub. No.: WO2009/047501

PCT Pub. Date: Apr. 16, 2009

(65) Prior Publication Data

US 2010/0208013 A1 Aug. 19, 2010

(30) Foreign Application Priority Data

Oct. 12, 2007 (GB) ..... 0720139.5

(51) Int. Cl.
*B41J 2/175* (2006.01)

(52) U.S. Cl. ..... 347/86

(58) Field of Classification Search ..... 347/19, 347/50, 85, 86

See application file for complete search history.

(56) References Cited

U.S. PATENT DOCUMENTS

| | | | | |
|---|---|---|---|---|
| 3,893,623 | A * | 7/1975 | Toupin | 239/102.2 |
| 4,360,817 | A * | 11/1982 | Arway et al. | 347/90 |
| 5,506,611 | A | 4/1996 | Ujita | |
| 5,860,363 | A | 1/1999 | Childers | |
| 6,010,210 | A | 1/2000 | Wilson | |
| 6,065,824 | A | 5/2000 | Bullock | |
| 6,130,695 | A | 10/2000 | Childers | |
| 6,196,670 | B1 | 3/2001 | Saruta | |
| 6,322,205 | B1 * | 11/2001 | Childers et al. | 347/85 |
| 6,416,152 | B1 | 7/2002 | Matsuzaki | |
| 6,585,359 | B1 * | 7/2003 | Gasvoda et al. | 347/86 |
| 6,672,695 | B1 | 1/2004 | Naka | |
| 6,705,712 | B2 | 3/2004 | Usui | |
| 6,789,876 | B2 | 9/2004 | Barclay | |
| 6,830,323 | B2 * | 12/2004 | Perkins et al. | 347/86 |
| 6,862,652 | B1 | 3/2005 | Tsuji | |
| 7,077,512 | B2 | 7/2006 | Kobayashi | |
| 7,168,797 | B2 | 1/2007 | Arai | |
| 7,396,114 | B2 * | 7/2008 | Ishizawa et al. | 347/86 |
| 7,562,958 | B2 * | 7/2009 | Asauchi | 347/19 |
| 2002/0001009 | A1 | 1/2002 | Gasvoda et al. | |
| 2002/0196312 | A1 | 12/2002 | Ishizawa | |
| 2003/0206220 | A1 | 11/2003 | Childers | |
| 2004/0056910 | A1 | 3/2004 | Usui et al. | |
| 2005/0024398 | A1 | 2/2005 | Kanamaru | |

* cited by examiner

FOREIGN PATENT DOCUMENTS

| | | |
|---|---|---|
| GB | 2350220 | 11/2000 |

*Primary Examiner* — Anh T. N. Vo
(74) *Attorney, Agent, or Firm* — Joseph A. Yosick

(57) ABSTRACT

An ink supply system for an ink jet printer, particularly a continuous ink jet printer, has a docking station where one of more disposable cartridges of ink or solvent are releasably connectable to the printer. The cartridge comprises an inner collapsible container with an outlet that is connectable to an inlet of the ink supply system and a substantially rigid outer housing. A front wall of the housing has an opening providing access to the outlet and a window that provides access to electrical contacts (92) associated with a memory device containing information relating to the contents of the cartridge. The contacts in a fixed relationship relative to the outlet so that when the cartridge is docked to establish fluid communication with the ink supply system the electrical contacts are electrically connected to respective contacts associated with the printer.

19 Claims, 4 Drawing Sheets

INK JET PRINTING

RELATED APPLICATIONS

This application claims priority under 35 U.S.C. §371 from PCT Application No. PCT/GB2008/003410, filed in English on Oct. 9, 2008, which claims the benefit of Great Britain Application Serial No. 0720139.5 filed on Oct. 12, 2007, the disclosures of which are incorporated by reference herein in their entireties The present invention relates to ink jet printing and more particularly to a fluid supply cartridge for an ink jet printer such as a continuous ink jet printer.

In ink jet printing systems the print is made up of individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurised ink to a print head drop generator where a continuous stream of ink emanating from a nozzle is broken up into individual regular drops by, for example, an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. The charged drops bypass the gutter and hit the substrate at a position determined by the charge on the drop and the position of the substrate relative to the print head. Typically the substrate is moved relative to the print head in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate).

In continuous ink jet printing a character is printed from a matrix comprising a regular array of potential drop positions. Each matrix comprises a plurality of columns (strokes), each being defined by a line comprising a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

Ink is delivered under pressure to the print head by an ink supply system that is generally housed within a sealed compartment of a cabinet that includes a separate compartment for control circuitry and a user interface panel. The system includes a main pump that draws the ink from a reservoir or tank via a filter and delivers it under pressure to the print head. As ink is consumed the reservoir is refilled as necessary from a replaceable ink cartridge that is releasably connected to the reservoir by a supply conduit. The ink is fed from the reservoir via a flexible delivery conduit to the print head. The unused ink drops captured by the gutter are recirculated to the reservoir via a return conduit by a pump. The flow of ink in each of the conduits is generally controlled by solenoid valves and/or other like components.

As the ink circulates through the system, there is a tendency for it to thicken as a result of solvent evaporation, particularly in relation to the recirculated ink that has been exposed to air in its passage between the nozzle and the gutter. In order to compensate for this, "make-up" solvent is added to the ink as required from a replaceable ink cartridge so as to maintain the ink viscosity within desired limits. This solvent may also be used for flushing components of the print head, such as the nozzle and the gutter, in a cleaning cycle.

The ink and solvent cartridges are filled with a predetermined quantity of fluid and generally releasably connected to the reservoir of the ink supply system by a flexible supply hose or tube so that the reservoir can be intermittently topped-up by drawing ink and/or solvent from the cartridges as required. To ensure the cartridges are brought into correct registration with the supply hoses they are typically connected to the ink supply system via a docking station comprising a cartridge holder. When the cartridges are correctly docked fluid communication with an outlet port of the cartridge is ensured.

It is important from the manufacturer's perspective that the ink jet printer is consumes only ink (or solvent) of the correct type and quality. If a cartridge containing the wrong ink is used the printing quality can be compromised and, in extreme cases, printer failure may be caused. It has thus become the convention to provide the cartridge with an externally machine readable label (e.g. a bar code) carrying information regarding the fluid contained within the cartridge. The label is swiped past a reader associated with the control system of the printer before the cartridge is installed and only when the control system of the printer has read the information on the label and verified that the ink is suitable for operation with the printer does it allow ink or solvent to be drawn from the cartridge.

It is one object of the present invention, amongst others, to provide for an improved or an alternative fluid cartridge for an ink jet printer and/or an alternative or improved ink jet printer.

According to a first aspect of the present invention there is provided a fluid cartridge for an ink jet printer, the cartridge comprising: an inner collapsible container for containing a printing fluid, the container having an outlet for connection to the printer; an outer housing in which the container is housed; an electronic storage device configured to store data relating to the contents of the cartridge; at least one electrical contact associated with the electronic storage device and provided on a substrate; the housing having a first aperture for said outlet, wherein the substrate has an aperture for location over the outlet of the container.

According to another aspect of the present invention there is provided a fluid cartridge for an ink jet printer, the cartridge comprising: an inner collapsible container for containing a printing fluid, the container having an outlet for connection to the printer; an outer housing in which the container is housed; an electronic storage device configured to store data relating to the contents of the cartridge; at least one electrical contact associated with the electronic storage device; the housing having a front wall with a first aperture for said outlet, the at least one electrical contact being disposed at the front wall.

The expression "being disposed at the front wall" is intended to include at least the possibility of the at least one electrical contact being mounted in, on or behind the front wall, providing it is accessible for connection to another contact provided on the printer. For example, the front wall may have a second aperture that provides access to the at least one electrical contact and the at least one electrical contact may be provided in the housing adjacent to the second aperture.

The fluid cartridge may be for ink or solvent or other such fluids used in the printing process.

The arrangement is such that when the cartridge is installed in a cartridge receiving portion of the printer the outlet is in fluid communication with an ink supply system of the printer and the at least one electrical contact is connected to at least one corresponding contact at the printer.

The first aperture may be disposed below the second aperture in the front wall.

The electrical storage device may be supported on the substrate which may be disposed between the housing and the inner container.

The substrate may be fixed relative to the outlet, perhaps by a holder defined on the inside of the housing which may take any suitable form including a pocket. The holder may comprise at least one fixing element that may have slots for supporting edges of the substrate.

The substrate may be mounted on the container directly or indirectly. It may be supported by an outer surface of the outlet. For example, the outlet may have a neck that supports the substrate. The edges of the substrate that define the aperture may be engaged with said outlet.

The substrate may be rigid or may be flexible. It may be in the form of a film, a label or the like or a card.

The container may have a rigid supporting surface adjacent to the substrate which may be provided by a wall having a thickness greater than that of the rest of the container wall.

A locking element may be provided for locking engagement with the substrate and this may be provided on the housing. The locking element may take any suitable form including, for example, a tongue with a terminal engaging formation such as a tip, rib or lip or the like for engagement in a slot or recess in the substrate.

The housing may comprise at least two separable portions, that when separated reveal the inner container. The housing may have at least one locating element for engagement with at least one complementary element on a cartridge holder. The at least one locating element can take any suitable form but may comprises a key for engagement with a slot in a cartridge holder or vice versa. The at least one locating element may be a recess for engagement with a protrusion on the holder.

The housing may have rigid side walls and at least one slit provided immediately adjacent corner portions of the side walls so that the corner portions can flex inwardly towards the container. At least one locating element may be defined on a surface of at least one of the corner portions, the at least one locating element being for engagement with a complementary element on a cartridge holder. The at least one locating element may be a rib or a recess or the like.

According to a further aspect of the present invention there may be provided an ink jet printer comprising a print head for generating ink drops for printing on a substrate, an ink supply system for supply ink to the print head, a fluid cartridge as defined above and a fluid cartridge receiving portion arranged to receive the fluid cartridge and to provide fluid communication between the cartridge outlet and the ink supply system, the fluid cartridge receiving portion having at least one electrical contact arranged for electrical contact with the at least one electrical contact on the cartridge when the cartridge is received.

The printer may be of the continuous type in which there is provided a catcher at the print head for receiving unused drops of ink generated and an ink return path for returning ink to the ink supply system.

According to a yet further aspect of the present invention there is provided fluid cartridge for an ink jet printer, the cartridge comprising: an inner collapsible container for containing a printing fluid, the container having an outlet for connection to the printer; an outer housing in which the container is housed; an electronic storage device configured to store data relating to the contents of the cartridge; at least one electrical contact associated with the electronic storage device and provided on a substrate; the substrate being fixed to the outlet.

The fixed relationship ensures that the outlet and the at least one electrical contact are in the correct positions for communication with elements on the printer, the outlet being intended to provide fluid communication with an ink supply system of the printer and the at least one electrical contact being for electrical connection to a corresponding contact on the printer side.

The substrate is fixed such that it does not move during collapse of the inner container, thereby ensuring electrical contact is maintained during use.

The substrate may be fixed to the outlet, in particular, it may be mounted on the outlet. For example, the substrate may have an aperture that receives the outlet whereby an edge of the substrate that defines the aperture is engaged with a surface of the outlet.

The electronic storage device may be mounted on said substrate or may be separately disposed but connected to the at least one electrical contact.

The outlet may comprise a rigid conduit extending from a wall of the container, the substrate being supported on the conduit and perhaps on a neck of the conduit. The outlet may be sealed by a penetrable sealing member, such as a septum seal that is penetrable by a needle connector.

According to yet a further aspect of the invention there is provided a fluid cartridge for an ink jet printer, the cartridge comprising: an inner collapsible container for containing a printing fluid, the container having an outlet for connection to the printer; an outer housing in which the container is housed; an electronic storage device configured to store data relating to the contents of the cartridge; at least one electrical contact associated with the electronic storage device; the housing having a front wall with a first aperture for said outlet, the at least one aperture being disposed at the front wall; wherein the outer housing has rigid side walls and at least one slit provided immediately adjacent corner portions of the side walls so that the corner portions can flex inwardly towards the container.

At least one locating element may be defined on a surface of at least one of the corner portions, the locating element being for engagement with a complementary element on a cartridge holder.

According to another aspect of the invention there is provided a fluid cartridge for an ink jet printer, the cartridge comprising: an inner collapsible container for containing a printing fluid, the container having an outlet for connection to the printer; an outer housing in which the container is housed; an electronic storage device configured to store data relating to the contents of the cartridge; at least one electrical contact associated with the electronic storage device and provided on a substrate; the housing having a front wall with a first aperture for said outlet, the at least one aperture being disposed at the front wall; and wherein the housing has a locking tongue with a formation for engagement in a slot or recess in the substrate.

A specific embodiment of the present invention will now be described, by way of example only, with reference to the accompanying drawings in which.

Figure 1:
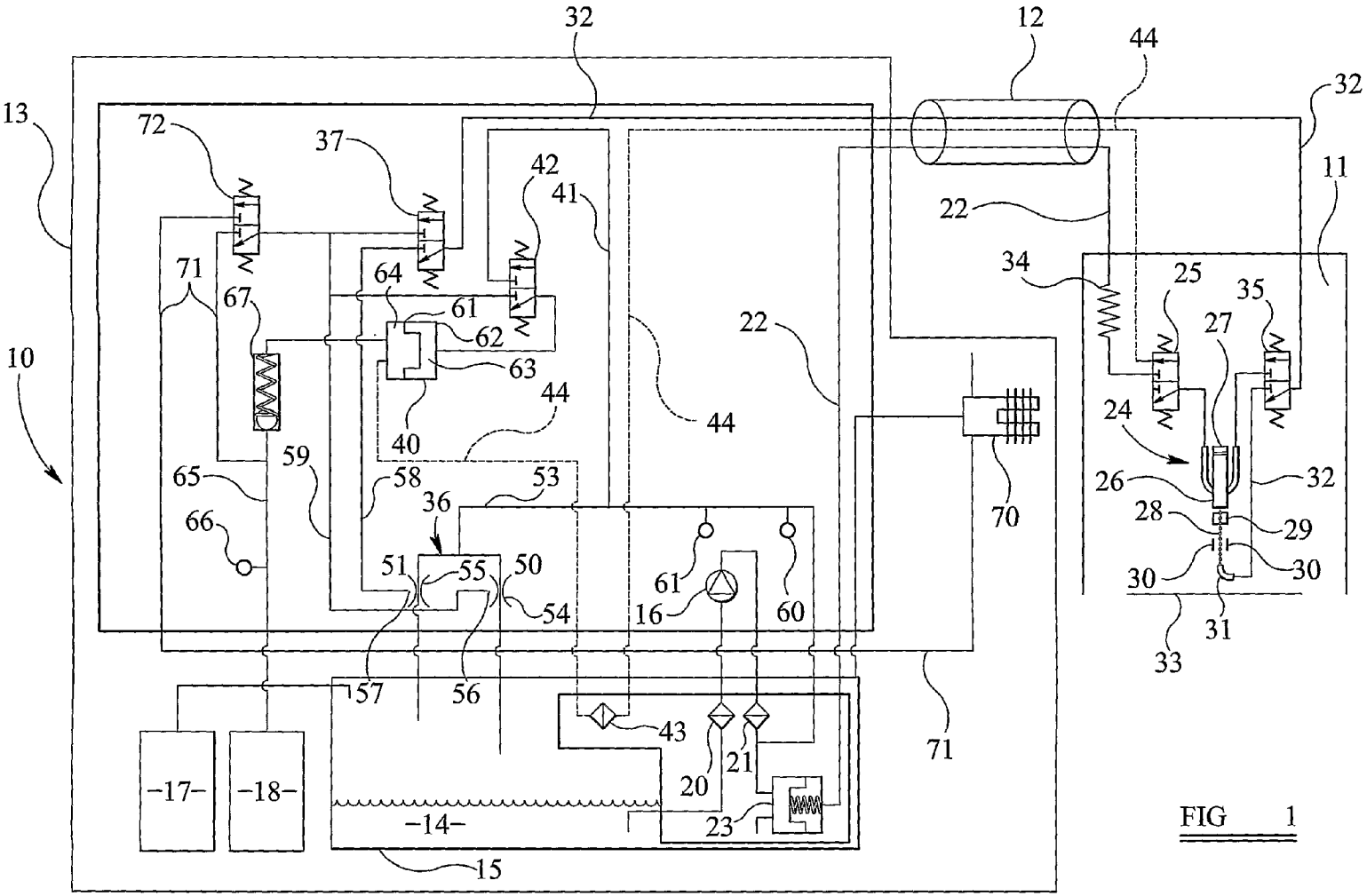
FIG. 1 is a schematic representation of an embodiment of a continuous ink jet printer of the present invention.

Referring now to the ink jet printer shown in FIG. 1 of the drawings, ink is delivered under pressure from an ink supply system 10 to a print head 11 and back via flexible tubes which are bundled together with other fluid tubes and electrical wires (not shown) into what is referred to in the art as an "umbilical" conduit 12. The ink supply system 10 is located in a cabinet 13 which is typically table mounted and the print head 11 is disposed outside of the cabinet. In operation, ink is drawn from a reservoir of ink 14 in a mixer tank 15 by a system pump 16, the tank 15 being topped up as necessary with ink and make-up solvent from replaceable ink and solvent cartridges 17, 18. Ink is transferred under pressure from the ink cartridge 17 to the mixer tank 15 as required and solvent is drawn from the solvent cartridge 18 by suction pressure as will be described.

It will be understood from the description that follows that the ink supply system 10 and the print head 11 include a number of flow control valves which are of the same general type: a dual coil solenoid-operated two-way, two port flow control valve. The operation of each of the valves is governed by a control system (not shown in the figures) that also controls operation of the pumps.

Ink drawn from the tank 15 is filtered first by a coarse filter 20 upstream of the system pump 16 and then by a relatively fine main ink filter 21 downstream of the pump 16 before it is delivered to an ink feed line 22 to the print head 11. A fluid damper 23 of conventional configuration and disposed upstream of the main filter 21 removes pressure pulsations caused by the operation of the system pump 16.

At the print head the ink from the feed line 22 is supplied to a drop generator 24 via a first flow control valve 25. The drop generator 24 comprises a nozzle 26 from which the pressurised ink is discharged and a piezoelectric oscillator 27 which creates pressure perturbations in the ink flow at a predetermined frequency and amplitude so as break up the ink stream into drops 28 of a regular size and spacing. The break up point is downstream of the nozzle 26 and coincides with a charge electrode 29 where a predetermined charge is applied to each drop 28. This charge determines the degree of deflection of the drop 28 as it passes a pair of deflection plates 30 between which a substantially constant electric field is maintained. Uncharged drops pass substantially undeflected to a gutter 31 from where they are recycled to the ink supply system 10 via return line 32. Charged drops are projected towards a substrate 33 that moves past the print head 11. The position at which each drop 28 impinges on the substrate 33 is determined by the amount of deflection of the drop and the speed of movement of the substrate. For example, if the substrate moves in a horizontal direction, the deflection of the drop determines its vertical position in the stroke of the character matrix.

In order to ensure effective operation of the drop generator 24 the temperature of the ink entering the print head 11 is maintained at a desired level by a heater 34 before it passes to the first control valve 25. In instances where the printer is started up from rest it is desirable to allow ink to bleed through the nozzle 26 without being projected toward the gutter 31 or substrate 33. The passage of the ink into the return line 32, whether it is the bleed flow or recycled unused ink captured by the gutter 31, is controlled by a second flow control valve 35. The returning ink is drawn back to the mixer tank 15 by a jet pump arrangement 36 and a third flow control valve 37 in the ink supply system 10.

As ink flows through the system and comes into contact with air in the tank 15 and at the print head 11, a portion of its solvent content tends to evaporate. The ink supply system 10 is therefore also designed to supply make-up solvent as required so as to maintain the viscosity of the ink within a predefined range suitable for use. Such solvent, provided from the cartridge 18, is also used to flush the print head 11 at appropriate times in order to keep it clear of blockages. The flush solvent is drawn through the system 10 by a flush pump valve 40 that is driven by a flow of ink in a branch conduit 41 under the control of a fourth flow control valve 42 as will be described below. The flush solvent is pumped out via a filter 43 through a flush line 44 (represented in dotted line in FIG. 1) that extends from the supply system 10 through the umbilical conduit 12 to the first flow control valve 25 in the print head 11. After passing through the nozzle 26 and into the gutter 31 the solvent is drawn into the return line 32 via the second control valve 35 and to the third control valve 37. The returning solvent flows under suction pressure from the jet pump arrangement 36.

The jet pump arrangement 36 comprises a pair of parallel venturi pumps 50, 51 that are supplied by pressurised ink from a branch line 53 from the outlet of the main filter 21. The pumps are of known configuration and make use of the Bernoulli Principle whereby fluid flowing through a restriction in a conduit increases to a high velocity jet at the restriction and creates a low pressure area. If a side port is provided at the restriction this low pressure can be used to draw in and entrain a second fluid in a conduit connected to the side port. In this instance, the pressurised ink flows through a pair of conduits 54, 55 and back to the mixer tank 15, each conduit 54, 55 having a side port 56, 57 at the venturi restriction. The increase in flow velocity of the ink creates a suction pressure at the side port 56, 57 and this serves to draw returning ink and/or solvent through lines 58, 59 when the third flow control valve 37 is open. The flow control valve 37 is operated such that the flow of returning ink/solvent to each venturi pump 50, 51 can be separately controlled. More specifically, the control system determines whether to allow flow through one or both venturi pumps 50, 51 depending on the temperature of the ink determined by a temperature sensor 60 in the branch line 53. If the ink has a relatively low temperature it will have a relatively high viscosity and therefore greater pumping power is required to draw ink back from the gutter 31 in which case both pumps 50, 51 should be operated. In the event that the ink has a relatively high temperature it will have a relatively low viscosity in which case the only one pump 50 is required to generate sufficient suction. Indeed operation of both the pumps should be avoided in the latter circumstance, as there would be a risk of air getting into the supply system, which serves to cause excess evaporation of the solvent, and therefore increased consumption of make-up solvent.

The branch line 53 is connected to line 41 that conveys ink to the flush pump valve 40 via the fourth flow control valve 42. When the control valve 42 is appropriately operated by the control system in order to effect flushing of the print head 11 it allows the flush pump valve 40 to be pressurised by the ink from line 41. The valve 40 is a rolling diaphragm type in which a resilient "top-hat" diaphragm 61 divides a valve housing 62 into first and second variable volume chambers 63, 64. Ink is supplied under pressure to the first chamber 63 and make up solvent is delivered from the cartridge 18 through a solvent supply line 65 to the second chamber 64 via a pressure transducer 66 and a non-return valve 67. The higher pressure of the ink entering the first chamber 63 relative to the solvent serves to deflect the diaphragm 61 from its normal position as shown in FIG. 1, to a position where the volume of the first chamber 63 has increased at the expense of the volume of the second chamber 64 and solvent is forced out of the second chamber 64 and towards the print head 11 via the flush line 44. It is to be appreciated that other flush pump designs may be used to achieve the same operation.

In use, the atmosphere above the mixer tank 15 soon becomes saturated with solvent and this is drawn into a condenser unit 70 where it is condensed and allowed to drain back into a solvent return line 71 via a fifth control valve 72 of the ink supply system.

Figure 2:
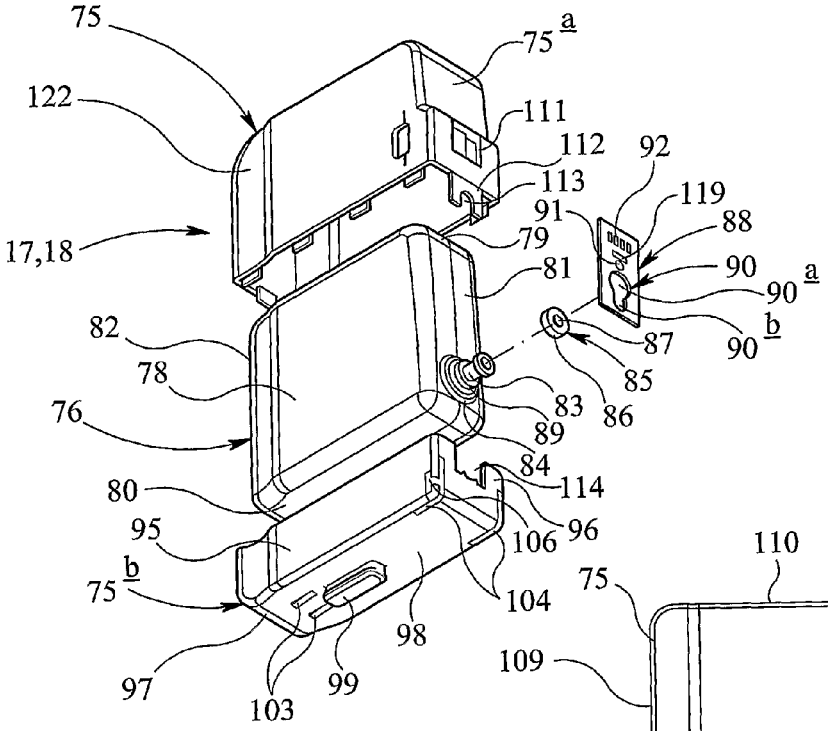
FIG. 2 is an exploded view of an embodiment of an ink cartridge in accordance with the present invention.
Figure 3A:
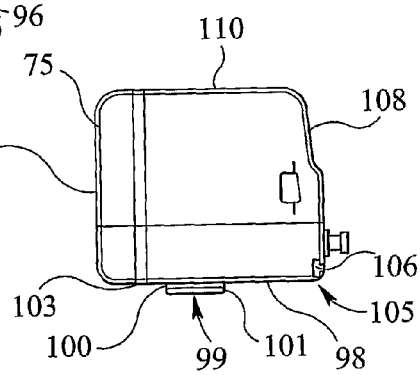
FIGS. 3A to 3C are side, underneath plan and front views of the cartridge of FIG. 2.
Figure 3B:
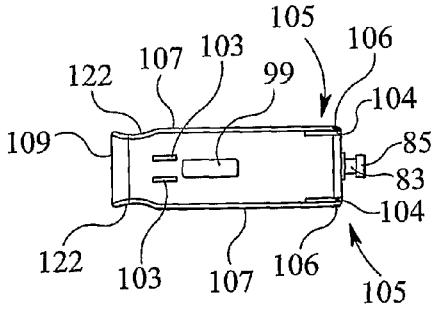
Figure 3C:
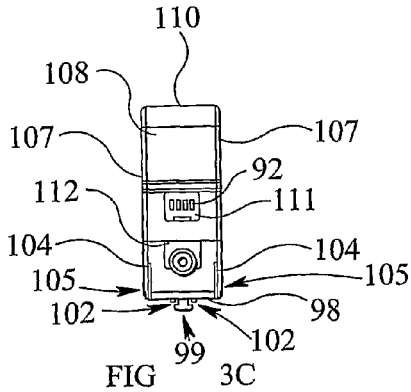
Figure 4A:
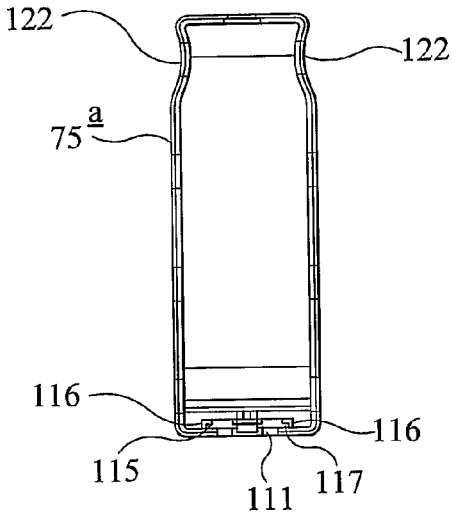
FIGS. 4A and 4B are front and sectioned side views of part of an outer housing of the cartridge of FIG. 2.
Figure 4B:
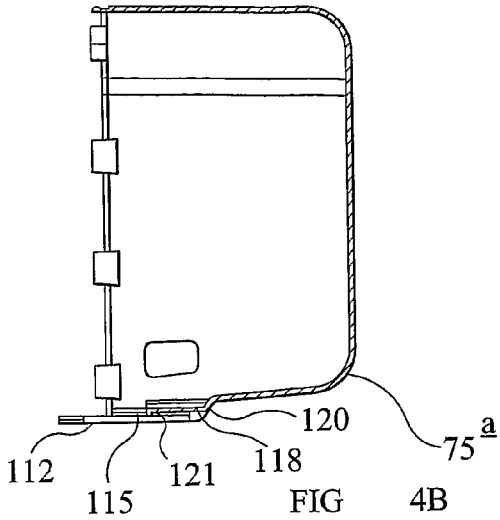
Figure 5A:
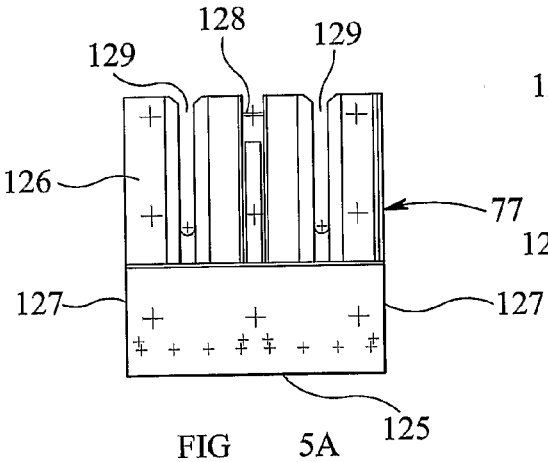
FIG. 5A is a plan view of a cartridge holder.
Figure 5B:
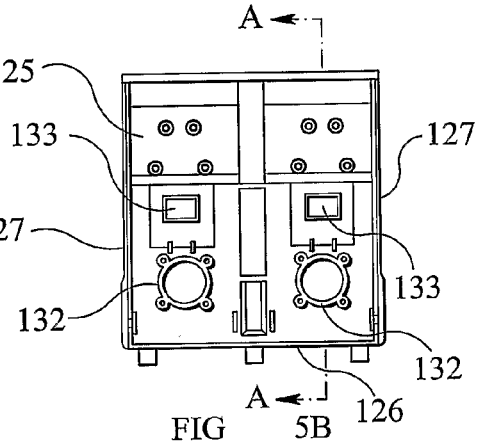
FIG. 5B is a front view of the cartridge holder of FIG. 5A.
Figure 5C:
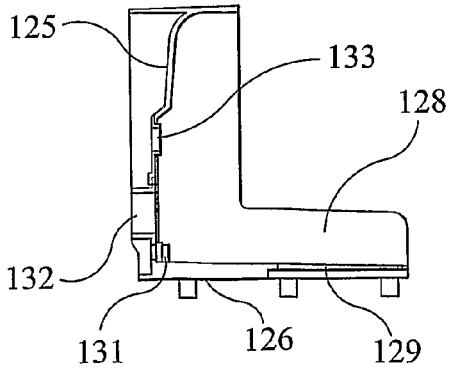
FIG. 5C is a sectioned side view of the cartridge holder, taken along line A-A of FIG. 5B.
Figure 5D:
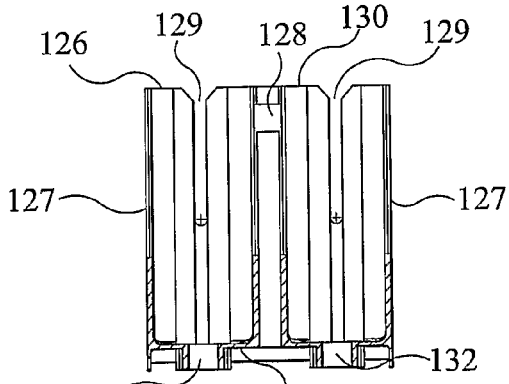
FIG. 5D is a sectioned view from above of the cartridge holder of FIG. 5A.

The two cartridges 17, 18, shown in FIGS. 2 to 4, are identical in structure and comprise a rigid outer housing 75 of a generally parallelepiped shape with an inner collapsible container 76 for storing the ink or solvent. The outer housing 75 has interconnected upper and lower portions 75*a*, 75*b* that are separable to expose the container 76.

In use, the cartridges 17, 18 are docked in a cartridge holder 77 (see FIGS. 5 and 6) that forms part of the printer, such that they are connected to the ink supply system 10. As ink or solvent is drawn from the cartridges 17, 18 by the ink supply system 10 the inner container 76 collapses within the outer housing 75, which remains undeformed.

The inner container 76 is made from a thin-walled plastics material such as, for example, HDPE and is of a similar shape to the inside of the cartridge housing 75 with a pair of opposed side walls 78, a top wall 79, a base wall 80 and front and rear walls 81, 82. An outlet port 83 extends from a raised circular area 84 at the front wall 81 and is closed by a septum seal 85. Such a seal 85 is conventional and comprises, for example, a cylindrical butyl sealing element with a protective aluminium alloy end cap 86 that has a central opening 87 so as to leave an end portion of the seal exposed for penetration by a needle connector (not shown) on the end of a supply hose of the ink supply system 10. The cartridge holder 77 is disposed adjacent to the needle connector such that as the cartridge 17, 18 is docked in the holder the seal is first brought into alignment with the needle connector and the cartridge is then pushed into engagement such that the needle penetrates the seal and fluid communication is made between the cartridge and the rest of the ink supply system. The walls of the container are thin (for example 0.35 to 1.00 mm) and flexible so as to allow it to collapse inwardly with relative ease as its fluid contents are drawn through the outlet port. However the raised circular area 84 around the outlet port 83 and the port 83 itself are of greater thickness to provide a degree of rigidity.

At least the ink cartridge 17 is provided with a data storage card 88 that enables identification of the contents of the cartridge. The outlet port 83 has a reduced diameter neck 89 over which the data storage card 88 is located. The card 88 is a rigid printed circuit board with a generally rectangular with an aperture 90 by which it is located over the neck 89. The shape of the aperture is configured to allow easily connection of the card 88 to the container 76, in particular it has main circular portion 90*a*, that is larger than the outer diameter of the outlet port 83 and thus allows the card 88 to be placed over the end of the port and a narrower slot 90*b* extending radially from one edge of the main portion 90*a*. Once the card 88 has been located over the port 83 it is moved laterally thereof to allow the slot 90*b* to slide over the neck 89 in a snug fit. In this position the card 88 is supported on the relatively flat and rigid raised circular area 84 around the outlet port 83. The card 88 is provided with a memory chip 91 along with surface-mounted electrical contacts 92 for connection to corresponding contacts provided on the printer. When the cartridge 17,18 is assembled the card 88 is supported between the housing 75 and the container 76 as will be described below.

The lower portion 75*b* of the cartridge housing 75 has opposed side walls 95, front and rear walls 96, 97, and a lower wall 98 on which there are defined several location or guide features that facilitate secure registration with the holder 77. The principal means of engagement with the holder 77 is provided by a key 99 that is designed to locate in a corresponding keyway slot in the holder so that the movement of the cartridge 17, 18 relative to the holder 77 is guided. The key 99 has an inverse T-shape with a narrow stem 100 and a slightly wider base web 101, the clearance between the web 101 and the surface of the lower wall 98 providing an elongate groove 102 on each side of the stem 100 for connection with part of the holder 77. Immediately behind the key 99 there is a pair of shallow ramps 103 and at the corners between the front and lower walls 96, 98 there is a pair of flared slits 104 that extend along a portion of the lower and front walls. These slits 104 allow the corner portions 105 of the side walls of the housing to flex laterally inwards relative to the rest of the housing 75 when suitable pressure is applied. Finally, there is a small locating recess 106 provided on each corner portion 105.

The upper portion 75*a* of the cartridge housing 75 similarly comprises opposed side walls 107, front and rear walls 108, 109 and an upper wall 110. When the housing portions 75*a*, 75*b* are connected together the respective side walls 95, 107 are substantially contiguous, as are the respective front 96, 108 and rear walls 97, 109. The front wall 108 has a substantially square aperture 111 disposed above a depending tab 112 with a U-shaped opening 113. In bringing the housing portions 75*a*, 75*b* together the tab 112 passes around the outlet port 83 of the inner container 76 and is received in a corresponding cut-out 114 in the front wall 96 of the housing lower portion 75*b*, the port 83 extending through the U-shaped opening 113.

When the cartridge housing portions 75*a*, 75*b* are assembled around the inner container 76, the data storage card 88 is supported in a pocket 115 (FIGS. 4A and 4B) defined on the inside surface of the front wall 108 adjacent to the tab 112. The pocket 115 is provided by a pair of spaced, elongate L-shaped formations 116 that each define a slot 117 with the inside surface of the front wall 108. Provided the card 88 is correctly located on the outlet port 83 of the inner container 76 its edges will be received in the slots 117 when the two housing portions 75*a*, 75*b* are brought together into mating engagement. The pocket 115 thus helps to ensure that the card 88 is correctly positioned relative to the housing 75 so that the contacts 92 are disposed in the correctly location for connection to the contacts on the printer. In addition to the pocket 115, the card 88 is also supported in position by a resilient locking tongue 118 that engages with a slot 119 in the card. The tongue 118 depends from a short inclined portion 120 of the front wall 108 and terminates in a protruding locking tip 121 for engagement with the slot 119 in the card 88. As the card 88 slides into the pocket 115 the tongue 118 is deflected rearwardly and rides over its rear surface until the tip 121 is aligned with the slot 119 thereby allowing the tongue 118 to flex forwards and into locking engagement with the card 88.

In order to allow easy manipulation of the cartridge 17, 18 when it is being docked with, or removed from, the holder 77, the side walls are each provided with an elongate, shallow arcuate recess 122 by which it can be grasped.

The cartridge holder 77 will now be described with reference to FIGS. 5A to 5D. It has a generally L-shaped appearance with perpendicular front and base walls 125, 126 joined by parallel L-shaped side walls 127 that are spaced apart so as to define between them an interior volume in which the cartridges 17, 18 can be removably received. This volume is divided into two side-by-side holder portions by a middle wall 128 that extends substantially in parallel to the side walls 127, such that each holder portion is designed to receive one cartridge. The base wall 126 has a pair of keyway slots 129, one in each holder portion, that extend approximately half way towards the front wall 125 from a rear edge 130. In use, these slots 129 are designed to receive the key 99 defined on the lower wall 98 of each cartridge housing 75. The inner surface of each side wall 127 has a small locating rib 131 adjacent to the corner with the base wall 126, the rib being for engagement in a corresponding recess 106 in the corner portion 105 of the cartridge 17, 18.

The cartridge holder 77 is located in the printer such that the front wall 125 affords an interface for the cartridges 17, 18 with the ink supply system 10. In particular, the front wall 125 has a pair of circular ports 132 that are in register with the needle connectors in the ink supply system 10 and, immediately above, a pair of square windows 133 in alignment with electrical contacts provided in the printer that are connected to the control system.

Figure 6:
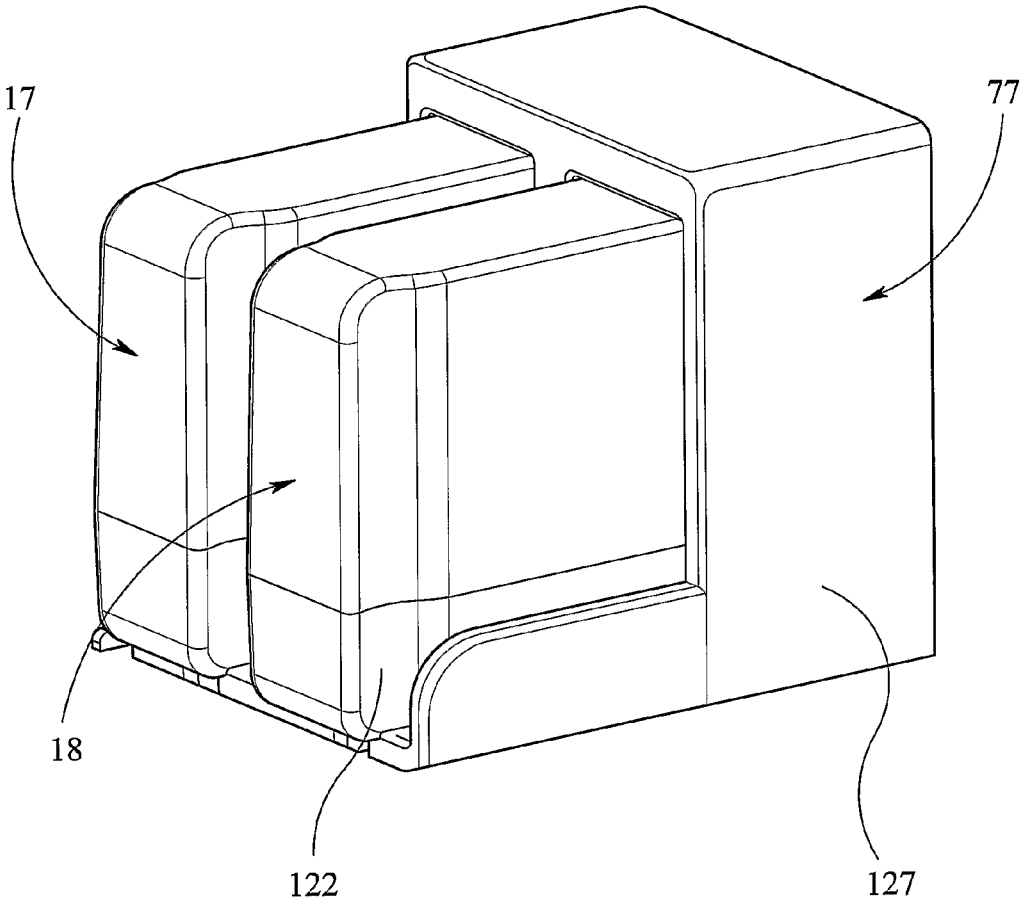
FIG. 6 is a perspective view of a pair of cartridges of FIGS. 2 to 4 engaged in the cartridge holder of FIG. 5.

The process of docking the cartridges 17, 18 with the holder 77 is a simple operation as will be appreciated by the following description and with reference to FIG. 6. The object is to ensure that cartridge 17, 18 is docked securely so that the needle connector has penetrated the seal in the outlet port 83 of the cartridge 17, 18 and the respective electrical contacts 92 on the data storage card 88 associated with the cartridge 17, 18 are in register with those on the printer side so as to allow electrical signals to be conducted between them.

Each assembled cartridge 17, 18 is offered to the corresponding holder portion by grasping it by the arcuate recess 122 and presenting the key 99 to the respective keyway slot 129 in the holder such that the edges of the base wall 126 of the holder around the slots 129 are received in the elongate grooves 102 of the key 99. The cartridge 17,18 is then slid forward so that the outlet port 83 of the inner container 76 passes through the respective circular port 132 in the front wall 125 of the holder 77 and the square aperture 111 in the housing is brought into alignment with the window 133 of the holder 77. As the cartridge 17, 18 approaches full engagement with the holder 77, the locating ribs 131 in the holder ride over the side walls 95 of the lower portion 75*b* of the housing and initially force the corner portions 105 inwards until the ribs 131 are brought into register with the locating recesses 106 whereupon the corner portions 105 snap back into place. At more or less the same time the ramps 103 engage with the surface of the base wall 126 of the holder 77 and serve to raise the cartridge 17, 18 very slightly relative to the holder 77 such that the key 99 is brought into frictional engagement with the edges of the keyway slots 129 in the base wall 126 of the holder 77. These two actions combine to provide for a secure and definite location of the cartridge 17, 18 such that the user intuitively feels when the cartridge docked and therefore knows that the needle connector has penetrated the seal in the cartridge and that the respective electrical contacts are in abutment. However, it will be appreciated that these locating features are not imperative to the successful operation of the cartridge in the printer and that they may be omitted. Alternatively, only one of such features may be provided.

As ink or solvent is drawn from the cartridge 17, 18 the inner container 76 collapses in a reasonably predictable manner with its side walls 78 moving inwards towards an intermediate plane mid-way between the side walls and substantially parallel thereto. The relatively thick rigid wall of the raised circular area 84 ensures that there is no significant tendency for it to collapse inwardly and thus apply a force on the port 83 that would tend to move it relative to the housing 75, which is undesirable. It will be appreciated that the combination of the rigidity of the container 76 in this area and the pocket 115 defined on the inside of the housing 75 ensures that the card 88 is maintained in position whilst the container 76 collapses so that the electrical contacts remain in abutment at all times.

It will be appreciated that numerous modifications to the above described embodiment may be made without departing from the scope of the invention as defined in the appended claims. In particular, the exact shape, size and arrangement of the locating features between the holder and the cartridge may vary. For example, any suitable connection between the holder and the cartridge may be provided that ensures the cartridge is guided into effective engagement with the holder and therefore effective connection to the printer. The male key 99 on the cartridge and the female keyway slots 129 on the holder 77 may be reversed and any other suitable male and female connection may be provided. Furthermore, the data storage memory chip 91 may be any suitable electronic storage device, may be supported on any suitable substrate and may be connected to suitable electrical contacts (or contact) in any convenient manner, providing those contacts are accessible for connection to the printer when the cartridge is docked in the housing. For example, access to the electrical contacts 92 may be provided by a substrate applied to the front wall 108 of the housing 75. The contacts 92 are connected to the data storage device 91 that may be supported on the substrate or located elsewhere such as in the housing. The substrate may take any suitable form such as a rigid card or a flexible adhesive film or label.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A fluid cartridge for an inkjet printer, the cartridge comprising:

an inner collapsible container for containing a printing fluid, the container having an outlet for connection to the printer;

an outer housing in which the container is housed, wherein the housing has rigid side walls and at least one slit provided immediately adjacent corner portions of the side walls so that the corner portions can flex inwardly towards the container;

an electronic storage device configured to store data relating to the contents of the cartridge;

at least one electrical contact associated with the electronic storage device and provided on a substrate;

the housing having a first aperture for said outlet and a second aperture that provides access to the at least one electrical contact, wherein the substrate is disposed between the outer housing and the container.

2. A fluid cartridge according to claim 1 wherein the outlet has a neck that supports the substrate.

3. A fluid cartridge according to claim 1, wherein the substrate is rigid.

4. A fluid cartridge according to claim 1, wherein the substrate is a card.

5. A fluid cartridge according to claim 1, wherein the container has a rigid supporting surface adjacent to the substrate.

6. A fluid cartridge according to claim 1, wherein the housing has a locking element for locking engagement with the substrate.

7. A fluid cartridge according to claim 6, wherein the locking element is a tongue with a tip for engagement in a slot or recess in the substrate.

8. A fluid cartridge according to claim 1, wherein at least one locating element is defined on a surface of at least one of the corner portions, the locating element being for engagement with a complementary element on a cartridge holder.

9. An ink jet printer comprising a print head for generating ink drops for printing on to a printable substrate, an ink supply system for supply ink to the print head, a fluid cartridge according to claim 1 and a fluid cartridge receiving portion arranged to receive the fluid cartridge and to provide fluid communication between the cartridge outlet and the ink supply system, the fluid cartridge receiving portion having at least one electrical contact arranged for electrical contact with the at least one electrical contact on the cartridge when the cartridge is received.

10. A ink jet printer according to claim 9, wherein the printer is of the continuous type in which there is provided a gutter at the print head for receiving unused drops of ink generated and an ink return path for returning ink to the ink supply system.

11. A fluid cartridge according to claim 1, wherein the substrate is fixed relative to the outlet by a pocket defined on the inside of the housing.

12. A fluid cartridge according to claim 11 wherein the pocket comprises at least one locking element having slots for supporting edges of the substrate.

13. A fluid cartridge for an inkjet printer, the cartridge comprising:

an inner collapsible container for containing a printing fluid, the container having an outlet for connection to the printer;

an outer housing in which the container is housed, the housing having a front wall with a first aperture for said outlet, wherein the housing has rigid side walls and at least one slit provided immediately adjacent corner portions of the side walls so that the corner portions can flex inwardly towards the container;

an electronic storage device configured to store data relating to the contents of the cartridge;

at least one electrical contact associated with the electronic storage device and provided on a substrate, wherein the substrate is fixed relative to the outlet by a pocket defined on the inside of the front wall of the housing, the front wall having a second aperture that provides access to the at least one electrical contact, and the at least one electrical contact provided in the housing adjacent to the second aperture.

14. A fluid cartridge according to claim 13, wherein the substrate is mounted on the outlet.

15. A fluid cartridge according to claim 13, wherein the electronic storage device is mounted on said substrate.

16. A fluid cartridge according to claim 13, the outlet comprising a rigid conduit extending from a wall of the container.

17. An ink jet printer comprising a print head for generating ink drops for printing on a substrate, an ink supply system for supply ink to the print head, a fluid cartridge according to claim 13, and a fluid cartridge receiving portion arranged to receive the fluid cartridge and to provide fluid communication between the cartridge and the ink supply system, the fluid cartridge receiving portion having at least one electrical contact arranged for electrical contact with the at least one electrical contact on the substrate when the cartridge is received.

18. A ink jet printer according to claim 17, wherein the printer is of the continuous type in which there is provided a gutter at the print head for receiving unused drops of ink generated and an ink return path for returning ink to the ink supply system.

19. A fluid cartridge according to claim 13 wherein the pocket comprises at least one locking element having slots for supporting edges of the substrate.

* * * * *